United States Patent [19]

Okuya et al.

[11] Patent Number: 4,962,364

[45] Date of Patent: Oct. 9, 1990

[54] ILLUMINATING TYPE LINEAR RESISTOR FOR VOLUME CONTROL

[75] Inventors: Tsutae Okuya; Tsuguhisa Hayashida, both of Miyagi, Japan

[73] Assignee: Alps Electric Co., Ltd., Tokyo, Japan

[21] Appl. No.: 228,669

[22] Filed: Aug. 4, 1988

[30] Foreign Application Priority Data

Nov. 18, 1987 [JP] Japan ..... 62-174973[U]

[51] Int. Cl.[5] ..... H01C 10/30

[52] U.S. Cl. ..... 338/119; 338/196; 338/176

[58] Field of Search ..... 338/119, 176, 161, 133, 338/137, 196, 160

[56] References Cited

U.S. PATENT DOCUMENTS

| | | | |
|---|---|---|---|
| 3,909,770 | 9/1975 | Oka et al. | 338/119 |
| 4,005,381 | 1/1977 | Klug | 338/119 |
| 4,426,634 | 1/1984 | Okuya et al. | 338/161 |

*Primary Examiner*—Bruce A. Reynolds

*Assistant Examiner*—M. M. Lateef

*Attorney, Agent, or Firm*—Guy W. Shoup; Paul J. Winters

[57] ABSTRACT

An illuminating type linear resistor for volume control having an insulating substrate; a pattern of resistor and collector formed on one surface of the insulating substrate; a lead formed on the other surface of the insulating substrate for supplying power to an LED; a slider mount assembly surrounding the insulating substrate and separatably formed into first and second slider mounts; a knob provided on the first slider mount which knob is formed at its upper end with a receiving portion for receiving the LED; a first slider mounted on the first slider mount and adapted to slidingly contact the pattern of resistor and collector; a second slider mounted on the second slider mount and adapted to slidingly contact the lead; and a clip provided at an extension of the second slider for holding a terminal of the LED which clip is received in the knob of the first slider mount.

5 Claims, 4 Drawing Sheets

ILLUMINATING TYPE LINEAR RESISTOR FOR VOLUME CONTROL

BACKGROUND OF THE INVENTION

The present invention relates to an illuminating type linear resistor for volume control.

FIG. 6 shows a conventional linear resistor for volume control. An insulating substrate 40 is provided on its one surface with a pattern of resistor and collector, etc. A U-shaped slider mount 41 consists of an upper plate 42, a side plate 43 and a lower plate 44. A knob 45 is provided to upright stand from the upper plate 42. The slider mount 41 is provided with sliders 46. The upper plate 42 and the lower plate 44 are formed at their ends with pawls 47 and 48, respectively. The pawls 47 and 48 are engaged with the insulating substrate 40 in such a manner that the slider mount 41 is slidable on the insulating substrate 40, and the sliders 46 resiliently contact tha pattern. Thus, the movement of the knob 45 causes a desired resistance between terminals.

Such a linear resistor for volume control as mentioned above has been increasingly needed to meet the requirements of low cost. However, there has not yet been proposed a linear resistor for control with a lighting device.

SUMMARY OF THE INVENTION

Accordingly, it is an object of the present invention to provide an illuminating type linear resistor for volume control which may be produced at low costs and includes a lighting device.

According to the present invention, there is provided an illuminating type linear resistor for volume control comprising an insulating substrate; a pattern of resistor and collector formed on one surface of the insulating substrate; a lead formed on the other surface of the insulating substrate for supplying power to an LED; a slider mount assembly surrounding the insulating substrate and separatably formed into first and second slider mounts; a knob provided on the first slider mount, said knob being formed at its upper end with a receiving portion for receiving the LED; a first slider mounted on the first slider mount and adapted to slidingly contact the pattern of resistor and collector; a second slider mounted on the second slider mount and adapted to slidingly contact the lead; and a clip provided at an extension of the second slider for holding a terminal of the LED, said clip being received in the knob of the first slider mount.

Other objects and features of the invention will be more fully understood from the following detailed description and appended claims when taken with the accompanying drawings.

DETAILED DESCRIPTION OF THE PREFERRED EMBODIMENTS

Figure 1:
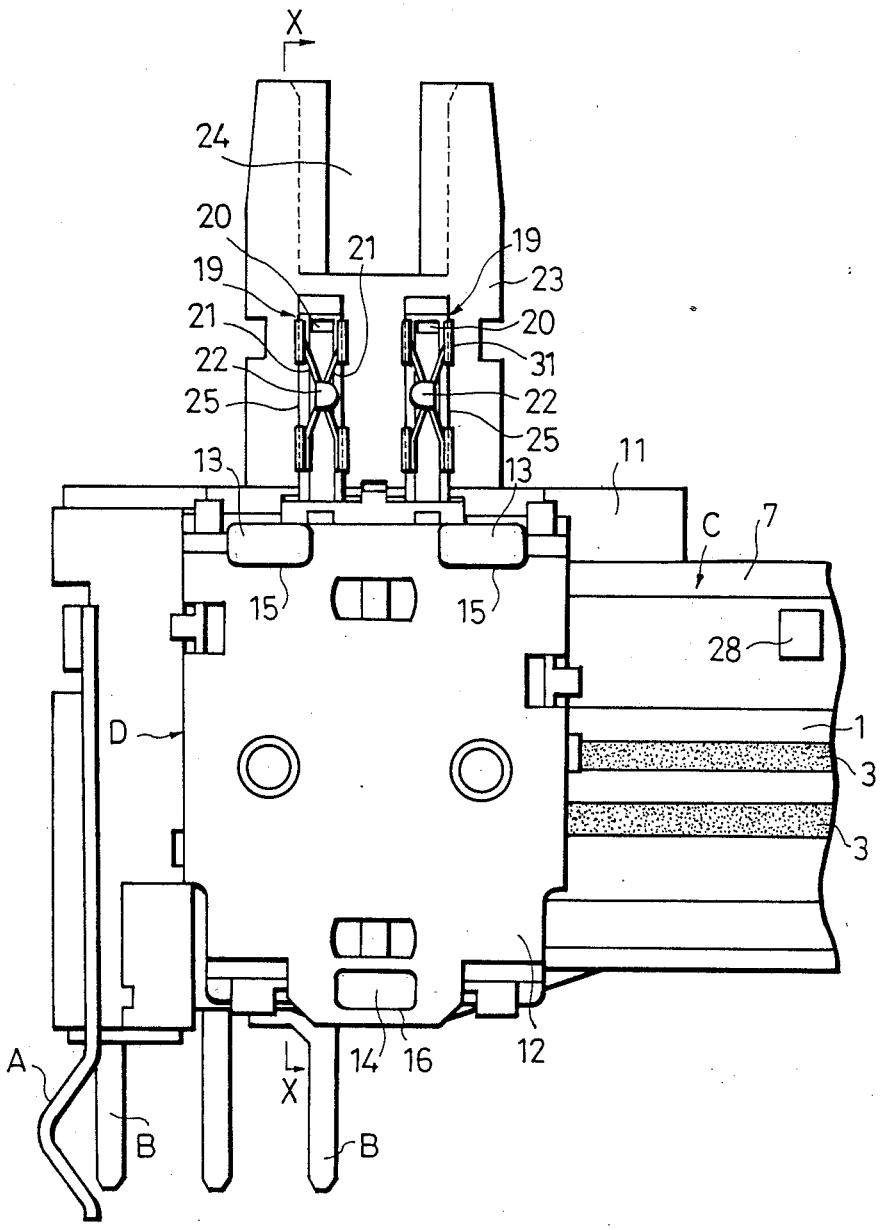
FIG. 1 is a front elevational view of a preferred embodiment of the linear resistor for volume control according to the present invention, with the LED omitted.
Figure 2:
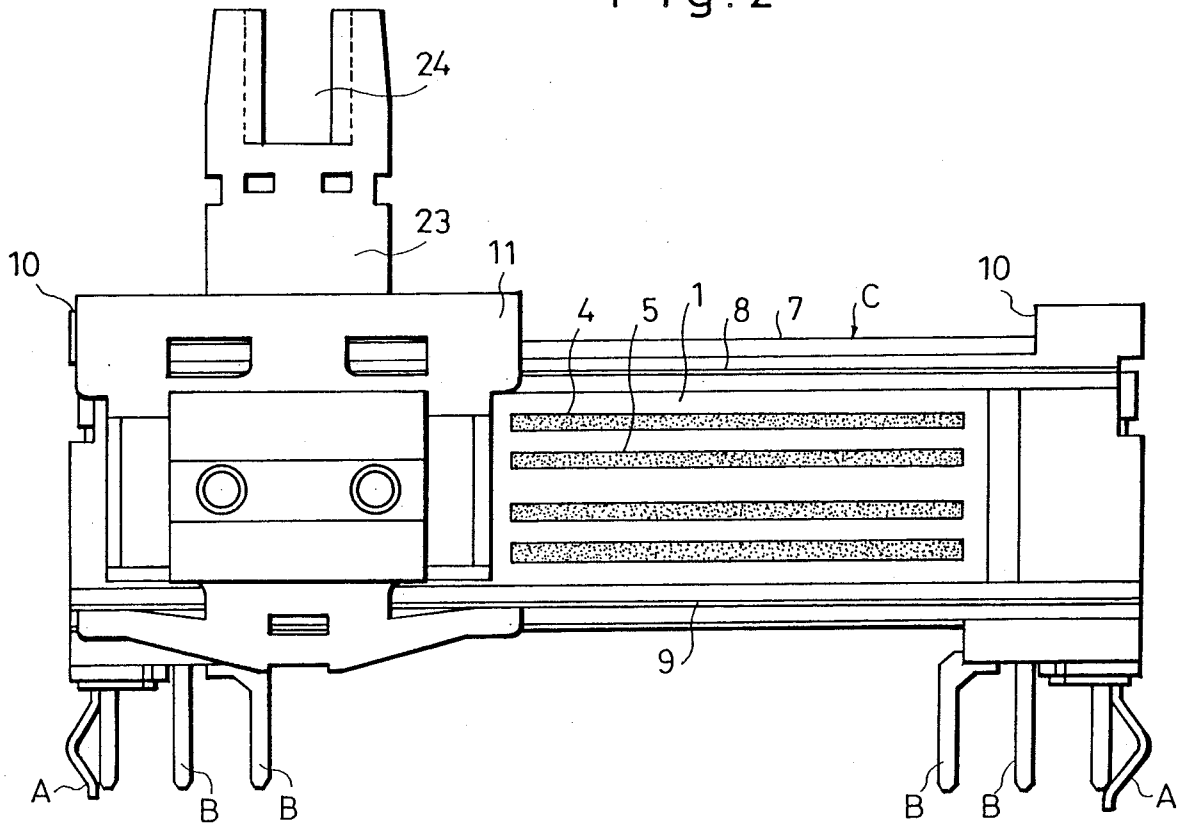
FIG. 2 is a rear elevational view of the preferred embodiment.

Referring now to FIGS. 1 to 4 which shows a preferred embodiment of the present invention, reference numeral 1 designates an insulating substrate. A pair of parallel leads 3 for supplying power to an LED 2 are formed by printing on an upper surface of the insulating substrate 1 in a longitudinal direction thereof. One of the leads 3 is connected at its one end with a terminal A disposed at one end of the insulating substrate 1, while the other lead 3 is connected at its one end with another terminal A disposed at the other end of the insulating substrate 1. Two pairs of a resistor 4 and a collector 5 are formed by printing on a lower surface of the insulating substrate 1 in the longitudinal direction thereof. The resistor 4 of each pair is connected at its both ends with terminals B disposed at both ends of the insulating substrate 1, while the collector 5 of each pair is connected at at least one end with terminals B. The insulating substrate 1 is covered with synthetic resin at connecting portions 6 of the terminals A and B and a peripheral portion 7 of the substrate 1 to form a frame C. The frame C is integrally formed with a pair of parallel projections 8 and 9 extending longitudinally of the insulating substrate 1 on the back surface thereof, so as to guide sliding movement of a first slider mount 11 which will be hereinafter described. The frame C is further formed with a pair of stoppers 10 at upper portions of the opposite ends thereof, and is further formed with a click recess 28 at a longitudinally central position of the upper portion thereof on the front side of the insulating substrate 1.

Figure 3:
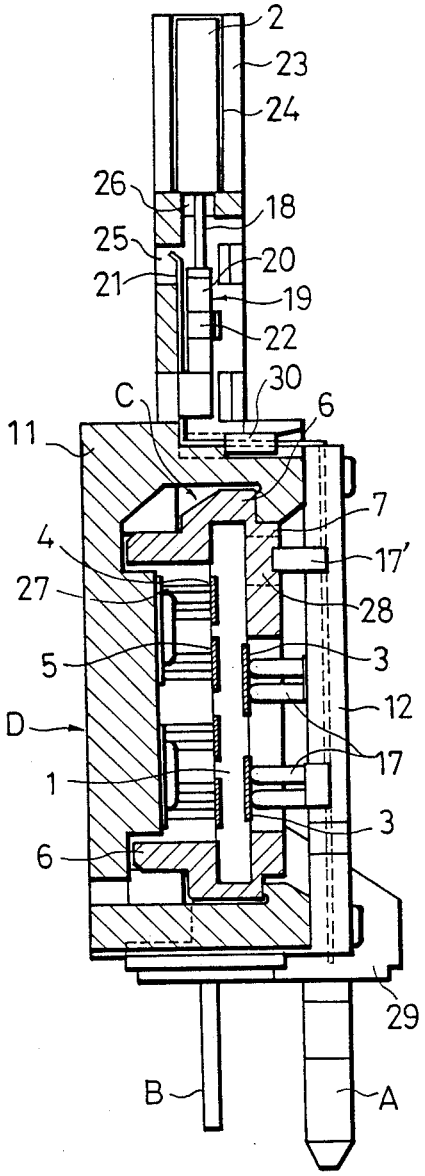
FIG. 3 is a cross section taken along the line X—X in FIG. 1, with the LED mounted.

Reference character D generally designates a slider mount assembly comprised of a first slider mount 11 and a second slider mount 12 which are separatable from each other. The slider mount assembly D is constructed by inserting a pair of projections 13 formed at an upper portion of the first slider mount 11 and a projection 14 formed at a lower portion of the first slider mount 11 into mount holes 15 and 16 formed through the second slider mount 12, respectively, and caulking each end of the projections 13 and 14. Thus, the insulating substrate 1 is sandwiched between the first and second mounts 11 and 12, and the slider mount assembly D is slidable in the longitudinal direction of the insulating substrate 1. As shown in FIG. 3, a pair of sliders 17 slidingly contacting the leads 3 for supplying power to the LED 2 and a click slider 17' are fixedly embedded at their base portions into an inner surface of the second slider mount 12 opposed to the front surface of the insulating substrate 1. The second slider mount 12 is provided at its upper portion with a pair of clips 19 integrally formed with the second sliders 17 for receiving a pair of terminals 18 of the LED 2. An intermediate portion between the clips 19 and the sliders 17 is retained by a retainer 30 integrally formed with the second slider mount 12 for stabilizing the clips 19.

Figure 4A:
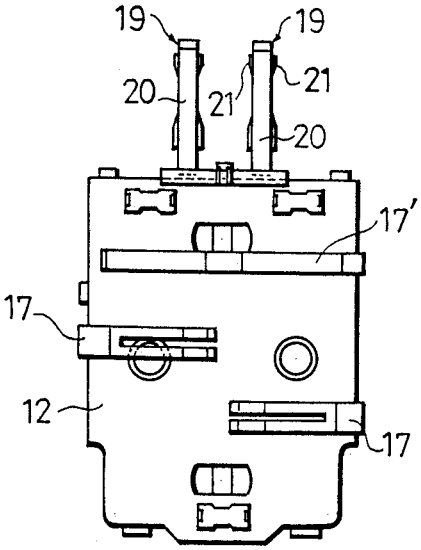
FIG. 4A is a front elevational view of the second slider mount.
Figure 4B:
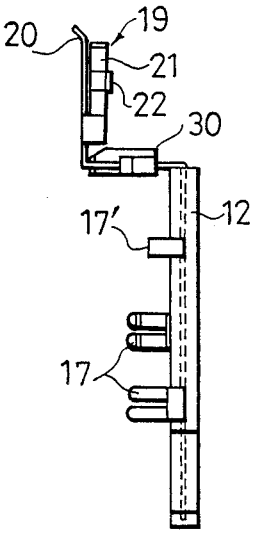
FIG. 4B is a side elevational view of the second slider mount.
Figure 4C:
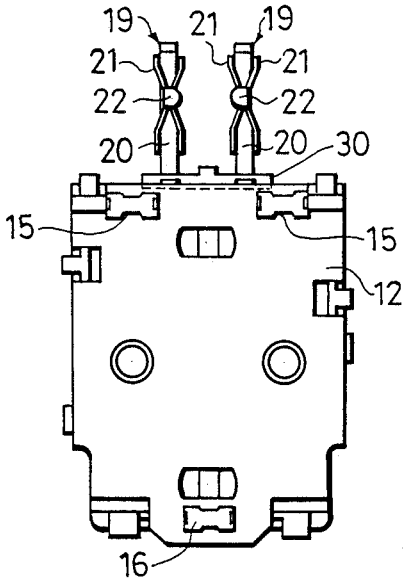
FIG. 4C is a rear elevational view of the second slider mount.

As best shown in FIGS. 4A to 4C, each clip 19 is formed from a single thin metal plate, and it is comprised of a central portion 20 extending upwardly and bent outwardly at its upper end and a pair of side wall portions 21 connected at their bottoms with the central portion 20 and opposed to each other to form a substantially sectional U-shaped construction in cooperation with the central portion 20. Each side wall portion 21 is formed in an inwardly arcuate shape at its intermediate portion, and both the side wall portions 21 contact with each other at their intermediate portion. Such a contact portion forms a sectional triangular shape in cooperation with the central portion 20. One of the side wall portions 21 is provided at its contact portion with a tongue 22 for preventing the terminal 18 of the LED 2 from getting out of the contact portions of the side wall portions 21 upon forcing of the terminal 18 into the contact portions.

The first slider mount 11 is provided with a knob 23 having an LED receiving portion 24 at an upper portion thereof, and is formed with a pair of recesses 25 for receiving the clips 19 on the side surface opposed to the second slider mount 12. As shown in FIG. 3, the first slider mount 11 is formed with a pair of holes 26 communicating the recesses 25 with the LED receiving portion 24 so as to insert the terminals 18 of the LED 2 therethrough. Each recess 25 is provided at its side surfaces with snap-in projections 31 each having frontwardly diverging inclined surface at the positions corresponding to upper and lower wide portions of the side wall portions 21 of the clip 19, so as to prevent the clips 19 from getting out of the recesses 25 after installation. As shown in FIG. 3, reference numeral 29 designates a resistor supporting member provided on the lower surface of the frame C, so that a resistor is mounted to stand.

In operation, when the knob 23 is moved in the longitudinal direction of the insulating substrate 1, sliders 27 fixed to the first slider mount 11 are slid on the resistors 4 and the collectors 5 to obtain a desired resistance between the pair of terminals B. Simultaneously, the sliders 17 fixed to the second slider mount 12 are slid on the leads 3 to turn on the LED 2. Further, when the slider 17' of the second slider mount 12 is brought into engagement with the recess 28 of the frame C, it can be recognized that the knob 23 is disposed at a longitudinally central position of the volume.

As mentioned above, the slider mount assembly D is separatably formed into the first and second slider mounts 11 and 12. A power supply circuit for supplying power to the LED 2 is formed by utilizing the second slider mount 12 and the front surface of the insulating substrate 1, and the sliders 17 fixed to the second slider mount 12 are connected with the terminals 18 of the LED 2 within the thickness of the knob 23 of the first slider mount 11. With this arrangement, the lighting device may be mounted to the inexpensive linear resistor for volume control.

Figure 5:
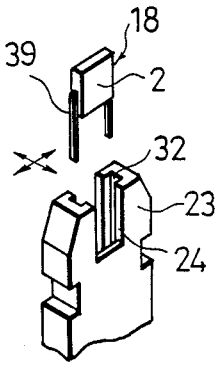
FIG. 5 is an exploded perspective view of another preferred embodiment of the mount structure of the terminal of the LED and the LED receiving portion of the knob.
Figure 6:
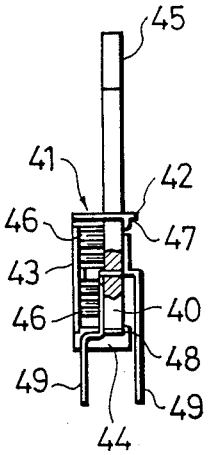
Fig. 6 PRIOR ART
FIG. 6 is a side elevational view of the conventional linear resistor for volume control.

Referring next to FIG. 5 which shows another preferred embodiment of the present invention, the terminal 18 of the LED 2 is provided with a pair of lugs 39, and the LED receiving portion 24 of the knob 23 is formed at its inner side surfaces with a pair of grooves 32 for engaging the lugs 39. Thus, the lugs 39 are engaged with the grooves 32 to install the LED 2 into the LED receiving portion 24 of the knob 23. With this arrangement, the LED 2 may be stably retained without looseness in the directions shown by the arrows.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An illuminating type linear resistor comprising an insulating substrate; a pattern of resistor and collector formed on one surface of said insulating substrate; a lead formed on the other surface of said insulating substrate for supplying power to an LED; a slider mount assembly surrounding said insulating substrate and separatably formed into first and second slider mounts; a knob provided on said first slider mount, said knob being formed at its upper end with a receiving portion for receiving said LED; a first slider mounted on said first slider mount and adapted to slidingly contact said pattern of resistor and collector; a second slider mounted on said second slider mount and adapted to slidingly contact said lead; and a clip provided at an extension of said second slider for holding a terminal of said LED, said clip being received in said knob of said first slider mount.

2. The illuminating type linear resistor as defined in claim 1, wherein said insulating substrate is covered with synthetic resin at connecting portions between terminals connected to said resistor and said collector and a peripheral portion of said substrate to form a frame, and said frame is integrally formed with a pair of parallel projections extending longitudinally of said insulating substrate on a back surface thereof so as to guide sliding movement of said first slider mount, and is further formed with a pair of stoppers at upper portions of opposite ends of said frame.

3. The illuminating type linear resistor as defined in claim 1, wherein said second slider comprises a pair of sliders and a click slider fixedly embedded at their base portions into an inner surface of said second slider mount opposed to a front surface of said insulating substrate, and said clip comprises a pair of clips integrally formed with said second slider for receiving a pair of terminals of said LED.

4. The illuminating type linear resistor as defined in claim 1, wherein said knob is formed with a recess for receiving said clip on a side surface opposed to said second slider mount, and is further formed with a hole for communicating said recess with said LED receiving portion so as to insert said terminal of said LED therethrough.

5. The illuminating type linear resistor as defined in claim 1, wherein said LED is of the type having a pair of lugs, and said LED receiving portion of said knob is formed at its inner side surfaces with a pair of grooves for engaging said lugs, so that said lugs are engaged with said grooves to install said LED into said LED receiving portion of said knob.

* * * * *